US006396373B1

(12) United States Patent
Gerdes et al.

(10) Patent No.: US 6,396,373 B1
(45) Date of Patent: May 28, 2002

(54) ADJUSTABLE ARMATURE ASSEMBLY FOR A CIRCUIT BREAKER AND METHOD OF USING SAME

(75) Inventors: Holly S. Gerdes; William J. Broghammer, both of Cedar Rapids, IA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/752,812

(22) Filed: Dec. 29, 2000

(51) Int. Cl.[7] ..... H01H 9/00
(52) U.S. Cl. ..... 335/176; 335/42
(58) Field of Search ..... 335/23–25, 35–43, 335/167–176

(56) References Cited

U.S. PATENT DOCUMENTS

| | | | | | |
|---|---|---|---|---|---|
| 2,920,161 | A | * | 1/1960 | Dessert et al. | 335/176 |
| 3,206,576 | A | * | 9/1965 | Michetti | 335/167 |
| 3,569,879 | A | * | 3/1971 | Gryctko | 335/176 |
| 6,242,993 | B1 | * | 6/2001 | Fleege et al. | 335/18 |

* cited by examiner

*Primary Examiner*—Lincoln Donovan
(74) *Attorney, Agent, or Firm*—Kareem M. Irfan; Larry I. Golden

(57) ABSTRACT

The present invention provides an armature assembly for adjusting the magnetic calibration of a tripping mechanism in a circuit breaker includes a bracket having a channel defined by a pair of legs and a bight with opposing sides. A first tab and a second tab are fixedly connected to opposing sides of the bight. The first and second tabs are positioned parallel to one another and perpendicular to the opposing sides of the bight. The first and second tabs have a respective first and second hole that are threaded. A first pin rotatably connects to the tripping mechanism within the interior of the circuit breaker. The first pin is affixed across the legs of the channel. An adjustment screw has an elongated body with a top portion on one end and at the opposing end a bottom portion. The adjustment screw has a plurality of screw threads defining an exterior side wall of the elongated body along the bottom portion. The plurality of screw threads configured to releasably engage the threaded fastener component. A washer has an approximate donut shape defined by relatively flat opposing surfaces. The washer is rotatably affixed though its center to the adjustment screw. A spring has one end attached to the washer and a second end attached to the interior of the circuit breaker to provide a bias with a force adjustable as the washer is moved by rotating the adjustment screw.

20 Claims, 3 Drawing Sheets

ADJUSTABLE ARMATURE ASSEMBLY FOR A CIRCUIT BREAKER AND METHOD OF USING SAME

FIELD OF THE INVENTION

The present invention relates to an armature assembly providing adjustment in the magnetic calibration of a tripping mechanism in a circuit breaker. In particular, the bias of a torsion spring is adjusted to bring the calibration of the tripping mechanism into the desired range.

BACKGROUND OF THE INVENTION

Load centers and other electrical distribution devices are commonly used in residential, commercial, and industrial applications. Individual circuit interrupters are mounted within these devices to protect branch circuits against overload and fault conditions. Basically, circuit interrupters like circuit breakers and fusible switches comprise a pair of separable contacts, a spring-operated mechanism for effecting separation of the contacts, and a tripping mechanism or fuse which automatically releases the operating mechanism upon occurrence of an overload or fault condition. The tripping mechanism is calibrated to a desired range usually by adjusting an armature or yoke gap.

A problem can arise in calibrating the tripping mechanism. The armature/yoke gap provides only a limited range of adjustment and can fail to bring the calibration of the tripping mechanism into the desired range. There usually is no other mechanism for adjusting the calibration of the tripping mechanism. Particularly with thermal magnetic circuit breakers, there usually is no mechanism for adjusting the magnetic calibration. As a result, the magnetic spring force used by the tripping mechanism must be held to very tight tolerances, further complicating the manufacturing process.

The need arises to provide a second mechanism for adjusting the calibration of the tripping mechanism for a circuit breaker. In particular, a mechanism for adjusting the magnetic calibration of a circuit breaker terminal could provide a more broad range of adjusting the calibration of the tripping mechanism than is currently available. The manufacturing process can also be simplified by easing the tolerances needed by the parts comprising the tripping mechanism.

SUMMARY OF THE INVENTION

The present invention provides a bracket for an armature assembly providing adjustment of the magnetic calibration of a tripping mechanism in a circuit breaker using an adjustment screw. The tripping mechanism connects to a first pin supported within the interior of the circuit breaker. The bracket includes a channel defined by a pair of legs and a bight with opposing sides. Each of the legs has a hole for affixing therein the first pin connected to the tripping mechanism. A first tab and a second tab are fixedly connected to opposing sides of the bight. The first and second tabs are positioned parallel to one another and perpendicular to the opposing sides of the bight. The first and second tabs have a respective first and second hole that are threaded for receiving therein the adjustment screw so that rotating the adjustment screw adjusts the position of the bracket relative to the interior of the circuit breaker and rotates the first pin to calibrate the tripping mechanism.

The present invention provides an armature assembly for adjusting the magnetic calibration of a tripping mechanism in a circuit breaker includes a bracket having a channel defined by a pair of legs and a bight with opposing sides. A first tab and a second tab are fixedly connected to opposing sides of the bight. The first and second tabs are positioned parallel to one another and perpendicular to the opposing sides of the bight. The first and second tabs have a respective first and second hole that are threaded. A first pin rotatably connects to the tripping mechanism within the interior of the circuit breaker. The first pin is affixed across the legs of the channel. An adjustment screw has an elongated body with a top portion on one end and at the opposing end a bottom portion. The adjustment screw has a plurality of screw threads defining an exterior side wall of the elongated body along the bottom portion. The plurality of screw threads configured to releasably engage the threaded fastener component. A washer has an approximate donut shape defined by relatively flat opposing surfaces. The washer is rotatably affixed though its center to the adjustment screw. A spring has one end attached to the washer and a second end attached to the interior of the circuit breaker to provide a bias with a force adjustable as the washer is moved by rotating the adjustment screw.

The present invention also provides a method of adjusting the magnetic calibration of a tripping mechanism in a circuit breaker. The steps of the method include: connecting a bracket having first and second tabs with first and second holes that are threaded to a first pin rotatably connecting to the tripping mechanism within the interior of the circuit breaker; engaging an adjustment screw through the threaded holes in the bracket; biasing the adjustment screw and bracket against a spring; and rotating the adjustment screw to adjust the distance between the bracket and screw to correspondingly adjust the bias on the tripping mechanism.

Advantages, embodiments, variations and the like will be apparent to those skilled-in-the-art from the present specification taken with the accompanying drawings and appended claims.

BRIEF DESCRIPTION OF THE DRAWINGS

In the drawings, which comprise a portion of this disclosure.

DETAILED DESCRIPTION OF THE INVENTION

Figure 1:
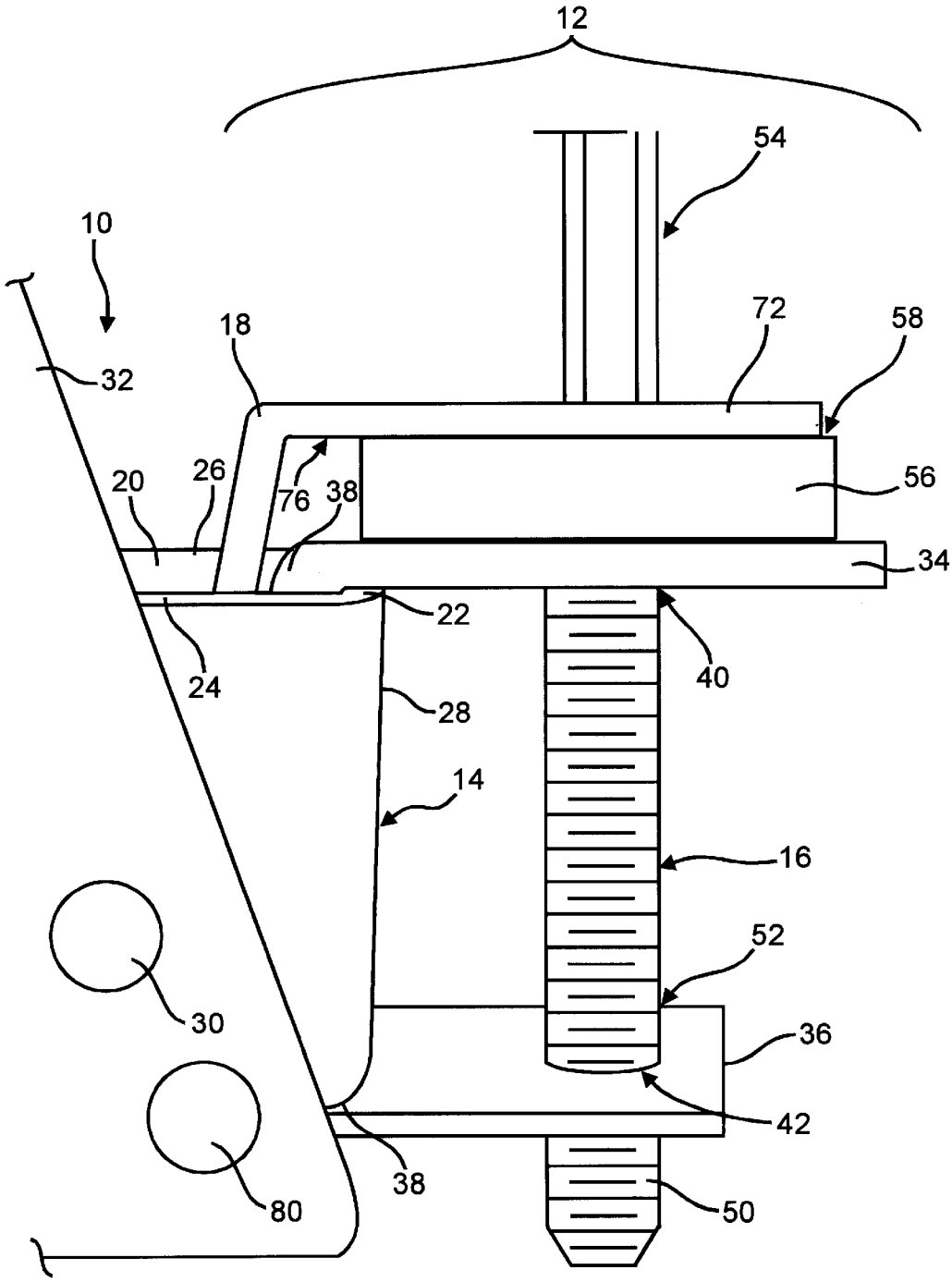
FIG. 1 is a fragmentary, side view of a circuit breaker with an adjustable armature assembly of the present invention having an adjusting screw, torsion spring, and bracket.

Referring now to FIG. 1, a thermal magnetic circuit breaker 10 includes an electrically insulating housing which encloses the components of the operating system (not shown) within its interior. Mounted within the circuit breaker 10 is an adjustable armature assembly 12 that includes a bracket 14, an adjustment screw 16, and a torsion spring 18. The bracket 14 includes a channel 20 defined by a pair of legs 24 and 26 and a bight 28. A first pin 30 is rotatably supported by a support bracket 32 within the interior of the circuit breaker 10 and is affixed to the channel legs 24 and 26. A first tab 34 and a second tab 36 fixedly connect to opposing sides 22, 38 of the bight 28 and extend perpendicularly away. The first and second tabs 34, 36 are positioned parallel to one another. The first and second tabs 34 and 36 include a respective first and second hole 40 and 42 that are threaded to engage the adjustment screw 16.

An elongated body 50 having a lower portion 52 that is threaded to engage the first and second holes 40 and 42 of the first and second tabs 34 and 36 defines the adjustment screw 16. An upper portion 54 is conveniently shaped to accommodate rotation manipulation by an operator either by hand or with a tool (not shown). FIG. 1 specifically illustrates a hex shaped upper portion 54 for engaging a tool although other embodiments are useable with the present invention. The adjustment screw 16 also includes a washer 56 encircles the upper portion 54 of the adjustment screw and can engage a bottom surface 76 of the torsion spring 18 and a top surface 58 of the first tab 34.

Figure 2:
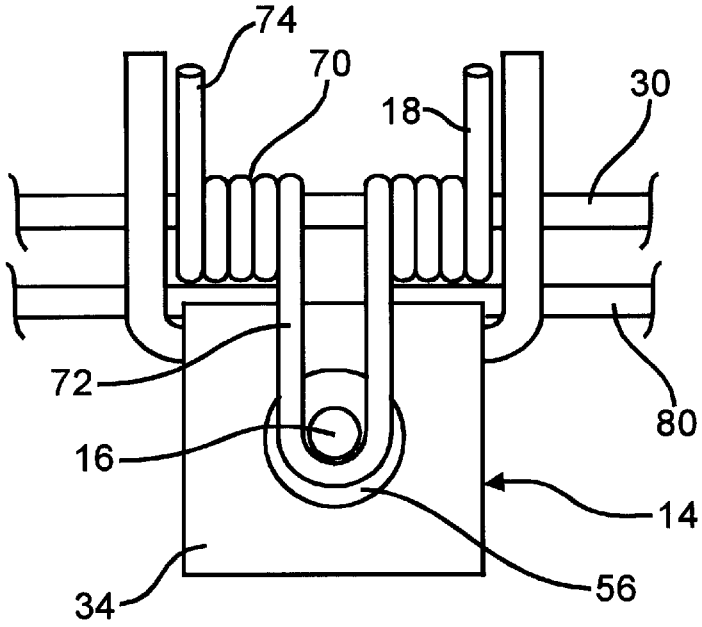
FIG. 2 is an isolated, top view of the adjustable assembly in FIG. 1.

The torsion spring 18 is illustrated in FIGS. 1 and 2, defined by a coiled body 70, a looped mid-section 72 and ends 74. Extending in a parallel direction through the middle of the coiled body 70 is the first pin 30 that allows the torsion spring 18 to rotate about its axis. The looped mid-section 72 of the torsion spring wraps around the upper portion 54 of the adjustment screw and has a bottom surface 76 for engaging the washer 56. The ends 74 of the torsion spring rest against a second pin 80 extending through the support bracket 32 and provides a bias on the coiled body 70 and the mid-section 72. The bias on the torsion spring 18 is increased when the top surface 58 of the washer engages and separates the bottom surface 76 of the looped mid-section 72 from the first tab 34.

Figure 3:
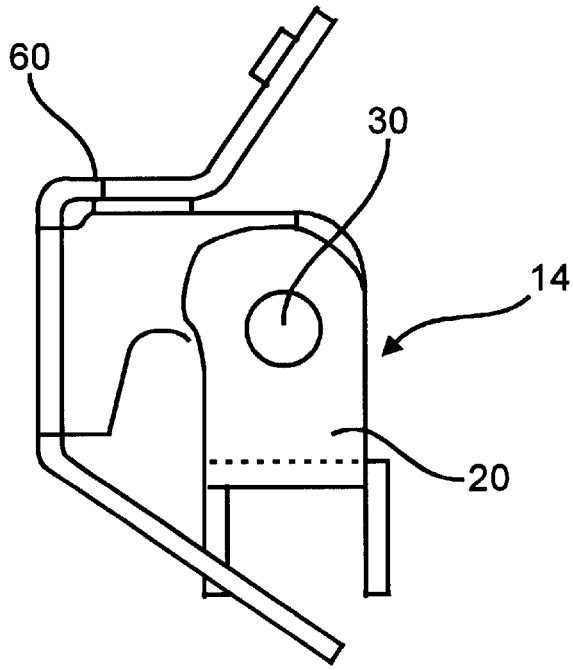
FIG. 3 is a side view of the bracket from the adjustable assembly of the present invention in FIG. 1.
Figure 4:
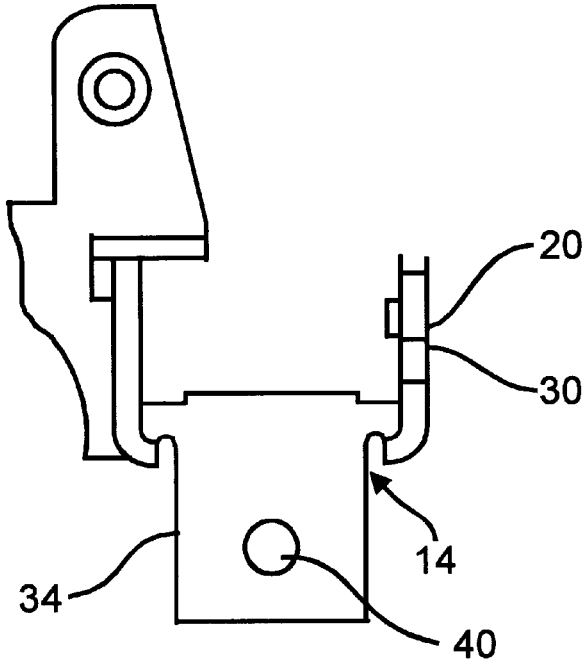
FIG. 4 is a fragmentary top view of the bracket in FIG. 3 isolating the means for releasably engaging the setting screw.

The bracket 14 is more specifically detailed in FIGS. 3 and 4 as affixedly connected to one end of the first pin 30 and rotatably affixed to a tripping mechanism generally referred to as numeral 60. In operation, the adjustment screw 16 is rotated and the washer 56 separates the mid-section 72 of the torsion spring from the first tab 34. As a result, the bias applied by the torsion spring 16 on the bracket 14 is increased. Since the bracket 14 is affixed to the first pin 30, the bias on rotating the first pin 30 is increased. Increasing the rotational bias on the first pin 30 adjusts the calibration of the tripping mechanism. Thus, rotating the adjustment screw 16 in either direction can increase or decrease the bias and adjust the calibration of the tripping mechanism.

Figure 5:
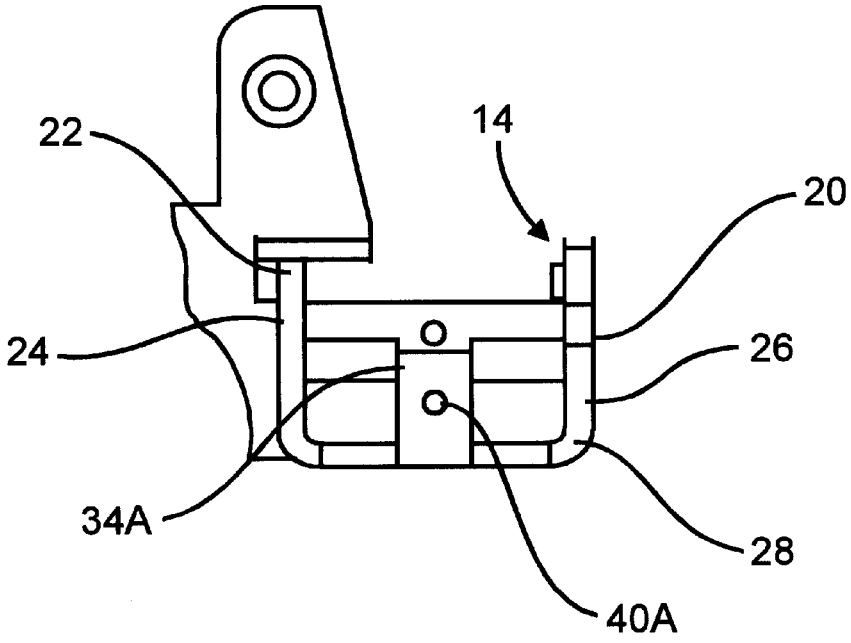
FIG. 5 is a fragmentary top view of another embodiment of the bracket in FIG. 4.

FIG. 5 illustrates another embodiment of the bracket 14 wherein the first tab 34A is moved within the bight 28 of the channel 20 between the first and second legs 24 and 26. The first tab 34A fixedly connects to one side 22 of the channel at the first and second legs 24 and 26. A hole 40A releasably attaches to the adjustment screw 16.

Although the inventive terminal has been described with regard to a thermal magnetic circuit breaker, the present invention is not so limited. The inventive armature assembly can be used with electronic circuit breakers and the like, which use a biased element to control the calibration of a tripping mechanism. The present invention provides a broad range of calibration adjustment and avoids the need for tight tolerances on parts that comprise the tripping mechanism.

While particular embodiments and applications of the present applications of the present invention have been illustrated and described, it is to be understood that the invention is not limited to the precise construction disclosed herein and that various modifications, changes, and variations will be apparent to those skilled in the art may be made in the arrangement, operation, and details of construction of the invention disclosed herein without departing from the spirit and scope of the invention as defined in the appended claims.

What is claimed is:

1. A bracket for an armature assembly providing adjustment of the magnetic calibration of a tripping mechanism in a circuit breaker using an adjustment screw to rotate the armature assembly affixed to the tripping mechanism to the desired calibration, the tripping mechanism connected to a first pin supported within the interior of the circuit breaker, the bracket comprising:

a channel defined by a pair of legs and a bight with opposing sides, each of the legs having a hole for affixing therein the first pin connected to the tripping mechanisms the channel affixed to the first pin and the calibration of the tripping mechanism; and a first tab and a second tab fixedly connect to opposing sides of the bight, the first and second tabs are positioned parallel to one another and perpendicular to the opposing sides of the bight in the opposite direction, the first and second tabs having a respective first and second hole that are threaded for receiving therein the adjustment screw, means for biasing the adjustment screw against the first tab, so that rotating the adjustment screw adjusts the position of the first tab, channel and the bracket relative to the bias means interior of the circuit breaker and rotates the channel and bracket about the first pin to calibrate the tripping mechanism affixed to the bracket.

2. The bracket of claim 1 wherein the biasing means is a spring, the first tab provides a surface for engaging one end of a the spring with a second end attached to the circuit breaker to provide a bias with a force adjustable as the adjustment screw is rotated by controlling the separation between the first tab and the one end of the spring.

3. The bracket of claim 2 wherein the spring is a torsion spring having a coiled body with a looped mid-section located between the ends, the coiled body extending in a parallel direction along the first pin that allows the coiled body to rotate about its axis, the adjustment screw having a washer affixed to one end, the looped mid-section wraps around the upper portion of the adjustment screw and has a bottom surface for engaging the washer so that the bias is adjusted as the adjustment screw and washer rotate to engage and separate the looped mid-section from the first tab to increase the bias of the spring on the first tab.

4. The bracket of claim 3 wherein the bracket further includes a second pin affixedly attached across the legs of the channel.

5. The bracket of claim 4 wherein at least one of the ends of the spring rest against the second pin extending across legs of the channel.

6. The bracket of claim 1 wherein the circuit breaker is a thermal magnetic circuit breaker.

7. The bracket of claim 1 wherein the first and second tabs extend outwardly from the bight of the channel.

8. The bracket of claim 1 wherein the first and second tabs extend inwardly from the bight of the channel.

9. The bracket of claim 8 wherein the first and second tabs are rigidly connected to the opposing sides of the bight.

10. An armature assembly for adjusting the magnetic calibration of a tripping mechanism in a circuit breaker by rotating the armature assembly affixed to the tripping mechanism to the desired calibration, the assembly comprising:

a bracket having a channel defined by a pair of legs and a bight with opposing sides, a first tab and a second tab fixedly connect connected to opposing sides of the bight, the first and second tabs are positioned parallel to one another and perpendicular to the said opposing sides of the bight, the first and second tabs having a respective first and second hole that are threaded;

a first pin rotatably connects to the tripping mechanism within the interior of the circuit breaker, the channel is affixed to the tripping mechanism, the first pin is affixed across the legs of the channel, rotating the channel about the first pin rotates the position of the tripping mechanism;

an adjustment screw having an elongated body having at one end a top portion and at the opposing end a bottom portion, the adjustment screw having a plurality of screw threads defining an exterior side wall of the elongated body along the bottom portion, the plurality of screw threads configured to which releasably engage the first and second hole of the first and second tabs threaded fastener component;

a washer having an approximate donut shape defined by relatively flat opposing surfaces, the washer rotatably affixed though its center to the adjustment screw; and a spring having one end attached to the washer and a second end attached to the interior of the circuit breaker to provide a bias with a force adjustable as the washer is moved by rotating the adjustment screw.

11. The assembly of claim 10 wherein the spring is a torsion spring having a coiled body with a looped mid-section located between the ends, the coiled body extending in a parallel direction along the first pin that allows the coiled body to rotate about its axis, the looped mid-section wraps around the upper portion of the adjustment screw and has a bottom surface for engaging the washer so that the bias is adjusted as the adjustment screw and washer rotate to engage and separate the looped mid-section from the first tab.

12. The assembly of claim 10 wherein the assembly further includes a second pin affixedly attached across the legs of the channel.

13. The assembly of claim 12 wherein at least one of the ends of the spring rest against the second pin extending across legs of the channel.

14. The assembly of claim 10 wherein the circuit breaker is a thermal magnetic circuit breaker.

15. The assembly of claim 10 wherein the adjustment screw is further defined by the top portion having a shape complimentary for engaging a tool.

16. The assembly of claim 10 wherein the first tab of the bracket provides a surface for engaging one end of the spring with a second end attached to the interior of the circuit breaker to provide a bias with a force adjustable as the adjustment screw is rotated.

17. The assembly of claim 10 wherein the first and second tabs of the bracket extend outwardly from the bight of the channel.

18. The assembly of claim 10 bracket wherein the first and second tabs of the bracket extend inwardly from the bight of the channel.

19. The assembly of claim 18 wherein the first and second tabs are rigidly connected to the opposing sides of the bight.

20. A method of adjusting the magnetic calibration of a tripping mechanism in a circuit breaker by rotating the armature assembly affixed to the tripping mechanism to the desired calibration, the method comprising:

providing connecting a bracket having first and second tabs with first and second holes that are threaded, affixing the bracket to the tripping mechanism and to a first pin allowing rotation of the bracket and tripping mechanism about the first pin rotatably connecting to the tripping mechanism within the interior of the circuit breaker;

engaging an adjustment screw through the threaded holes in the bracket;

biasing the adjustment screw and bracket against one end of a spring with the other end of the spring fixed against the circuit breaker; and rotating the adjustment screw to adjust the separation distance between the bracket and screw to correspondingly adjust the bias on the tripping mechanism one end of the spring biasing the adjustment screw against the bracket, so that rotating the adjustment screw adjusts the position of the bracket relative to the end of the spring and rotates the bracket about the first pin to calibrate the tripping mechanism affixed to the bracket to correspondingly adjust the bias on the tripping mechanism.

* * * * *